US005319815A

United States Patent [19]

Stumpf et al.

[11] Patent Number: 5,319,815

[45] Date of Patent: Jun. 14, 1994

[54] BOX SPRING CORE WITH COMPARTMENTALIZED SPRINGS

[75] Inventors: Walter Stumpf, Betzdorf; Helmut Gerking, Bochum, both of Fed. Rep. of Germany

[73] Assignee: Schlaraffia-Werke Huser GmbH & Co. KG, Bochum, Fed. Rep. of Germany

[21] Appl. No.: 972,494

[22] PCT Filed: Aug. 20, 1991

[86] PCT No.: PCT/DE91/00665

§ 371 Date: Feb. 8, 1993

§ 102(e) Date: Feb. 8, 1993

[87] PCT Pub. No.: WO92/03077

PCT Pub. Date: Mar. 5, 1992

[30] Foreign Application Priority Data

Aug. 22, 1990 [DE] Fed. Rep. of Germany ..... 4026502
Dec. 15, 1990 [DE] Fed. Rep. of Germany ..... 4040220
Dec. 31, 1990 [DE] Fed. Rep. of Germany ..... 4042304

[51] Int. Cl.[5] ..... A47C 27/07; A47C 27/06; A47C 23/04

[52] U.S. Cl. ..... 5/477

[58] Field of Search ..... 5/477, 475, 476, 478

[56] References Cited

U.S. PATENT DOCUMENTS 1,284,384 11/1918 Lewis ..... 5/477
4,523,344 6/1985 Stumpf et al. ..... 5/477
4,578,834 4/1986 Stumpf ..... 5/477

*Primary Examiner*—Alexander Grosz
*Attorney, Agent, or Firm*—Herbert Dubno; Andrew Wilford

[57] ABSTRACT

A box-spring core has a first group of first chains extending spacedly adjacent and parallel to one another and a second group of second chains extending adjacent and parallel to one another and transversely of the first chains. Each of the chains has an elongated flexible sheath formed with a plurality of longitudinally spaced, transversely extending, and through-going slits that are each transversely aligned with the slits of adjacent sheaths, a transverse seam adjacent each slit and internally subdividing the respective sheath into a respective succession of longitudinally spaced pockets, and respective springs in the respective pockets each compressible in a transverse direction parallel to the slits. The springs have opposite ends lying generally in respective parallel planes. Each slit has a predetermined length measured perpendicularly between the planes and the combined lengths of a pair of interfitting slits are generally equal to the predetermined height.

12 Claims, 5 Drawing Sheets

BOX SPRING CORE WITH COMPARTMENTALIZED SPRINGS

FIELD OF THE INVENTION

The invention relates to a box-spring core with a plurality of parallel chains of boxed springs, each chain having a continuous row of springs which are closely encased by a cloth-like sheath and connected by same to one another with the thus formed pockets of a chain having transverse seams restricting the springs and extending parallel to the longitudinal axes of the springs and where furthermore the adjacent chains are mechanically joined to one another.

BACKGROUND OF THE INVENTION

Such boxed spring cores are known for example from EP 154,076. Here parallel chains are connected together by means of glue. Box spring cores are further known from the state of the art wherein a mechanical connection is formed by throughgoing connecting filaments.

The use of glue is disadvantageous in that on the one hand it requires the use of an additional material, the glue, and on the other hand applying devices for the glue must be provided and time must be set aside for curing of the glue. In the hitherto known mechanical connection systems a substantial amount of equipment is necessary, and in addition the use of connecting filaments is disadvantageous both during manufacture and during further handling.

OBJECT OF THE INVENTION

Starting from this state of the art, it is an object of the invention to provide a box-spring core of the described type where the connection of adjacent chains takes place without additional material.

SUMMARY OF THE INVENTION

In order to achieve these objects, the invention suggests that the chains have in the region of the connecting seams insert slits extending over half of the chain height and open to the same edge, that a first group of the chains are arranged parallel to and at a spacing from one another with their slits directed in the same direction and that a second group of chains is arranged parallel to and at a spacing from one another and at a right angle to the first number of chains with their slits directed in the same direction and oppositely to those of the first group, and the first and second groups of chains are arranged with interengaging slits in rows and columns with the spaces formed between parallel rows filled in gaps between the elements of the first group of chains by elements of the second group of chains so that the elements of adjacent rows or columns are staggered relative to each other.

With the arrangement of the invention it is only necessary to provide the slits in the region of the connecting seams of the chains. The thus formed chains can then be arranged relative to each other in rows and columns at right angles to each other and can be fitted together with interfitting slits without the use of additional material. It is not necessary to provide glue connections, weld connections, stitched connections, stapled connections, or the like. The arrangement according to the invention forms a spring core in which the chains are arranged in rows and columns with relatively tight packing of the boxed springs to form a box-spring core exclusively by interengagement of the slit regions. In this manner an exact outer dimension of the box spring is attained with no relative shifting of the springs in the length and/or width possible since the insert slits in the seam region achieve an exact positioning. In addition a tight surface orientation with boxed springs is obtained which leads to high stability of the spring core. Furthermore substantial hardness of the box-spring core is obtained which has hitherto only been achievable by relatively thick wires in the spring elements.

A preferable embodiment is that respective double seams are formed between the boxed springs of a chain and each insert slit is formed between the respective pair of connecting seams.

This ensures that when making the dividing slits the connecting seam is not severed, which could lead to a releasing of the boxed springs in this region.

Furthermore it can be advantageous to form a web of the sheathing material of the boxed springs between each pair of connecting seams of a chain.

A further embodiment of a box-spring core in accordance with the objects is that the chains have in the region of the connecting seams insert slits open to the same edge, that a first group of the chains are arranged parallel to and at a spacing from one another with their slits directed in the same direction and that a second group of chains is arranged parallel to and at a spacing from one another and at a right angle to the first number of chains with their slits directed in the same direction and oppositely to those of the first group, and the first and second groups of chains are arranged with interengaging slits in rows and columns with the spaces formed between parallel rows filled in gaps between the elements of the first group of chains by elements of the second group of chains so that the elements of adjacent rows or columns are staggered relative to each other and the interengaging insert slits of the first and second chains are dimensioned so relative to each other that two planes almost formed by the end faces of the boxed springs extend parallel to an at a spacing from each other and the ends of all the springs lie in these planes.

Whether the slits extend only over half of the chain height or have different lengths is not critical so long as once the chains are fitted together a box-spring core is produced with two relatively parallel support surfaces, the ends of the boxed springs lying on these support surfaces. It is for example possible to let the slits run substantially longer than half the height of a chain so that when two chains with such slits are fitted together bending of the chains in the region of the slits is facilitated. It is also however possible to provide one chain with relatively short slits that do not even reach to the middle of the chain height and to provide the other chain with substantially longer slits that extend past its middle so long as the result is an end product with two relatively parallel support surfaces. Theoretically it is also possible to form the slits of one chain of different heights so long once again as the effect is that the box-spring core as an end product has two relatively parallel support surfaces. It is also theoretically possible to extend the insert slits in the one chain over almost the entire height of the boxed springs and to almost completely eliminate the insert slits in the other chain, which fit into these wide-open slits, so long as the two chains fit together in the above-described manner while maintaining the above-given requirements.

A further object of the invention is a box-spring core with a plurality of parallel chains of boxed springs, each chain having a continuous row of springs which are closely encased by a clothlike sheath and connected by same to one another with the thus formed pockets of a chain having transverse seams restricting the springs and extending parallel to the longitudinal axes of the springs and where further the adjacent chains are mechanically joined to one another.

To achieve the above-given objects, with chains which have in the region of the connecting seams slits open to the edge, a first group of chains with slits extends parallel to and at a spacing from one another that a second group of chains is arranged parallel to and at a spacing from one another and at a right angle to the first number of chains with their slits directed in the same direction and oppositely to those of the first group, and the first and second groups of chains are arranged with interengaging slits in rows and columns with the spaces formed between parallel rows filled in gaps between the elements of the first group of chains by elements of the second group of chains so that the elements of adjacent rows or columns are staggered relative to each other and that the slits of each chain are formed singly or in groups alternatingly open to one or the other edge.

In this arrangement the interengaging slits of the first and second chains are so dimensioned relative to each other that the ends of all the boxed springs lie in the box-spring core planes extending parallel to each other.

Furthermore the first and second chains are engaged together by the alternate interengaging slits like a weave.

For stability reasons it is advantageous that the slits each extend over half of the chain height of the chain.

The above-described embodiment ensures that the chains can be interfitted like a weave so that the finished box-spring core constitutes an intermediate product that holds better together and that can be handled with less care until it is worked into a mattress in finished form. The offset arrangement of the slits and the resulting possibility of woven interfitting of the chains eliminates the danger that careless handling of the box-spring core before it is finished can lead to it slipping apart.

For further obtaining the above-described objects the invention proposes as a parallel solution that a first group of the chains has in the region of the connecting seams insert slits open to the same edge and spaced from on another, a second group of chains is arranged parallel to and at a spacing from one another, and the first and second groups of chains are arranged with interengaging slits in rows and columns with the spaces formed between parallel rows filled in gaps between the elements of the first group of chains by elements of the second group of chains so that the elements of adjacent rows or columns are staggered relative to each other, and that the slits are formed only in the region of open elongated holes which lie between the planes formed by the ends of the boxed springs and that each chain of the second group of chains is arranged to engage through the aligned elongated holes of the family of the first group of chains a portion of a connecting seam of the chain of the second chain being arranged in the region of each elongated-hole through engagement.

This arrangement makes it possible for example with a group of parallel chains of the first type whose elongated holes are arranged coaxially with one another to insert through each coaxial row of elongated holes a chain of the second type, with the chains of the second group each sitting in the region of their connecting seams in an elongated hole. This achieves a solid mechanical connection of the chains with each other so that a corresponding box-spring core is formed. In order to facilitate the insertion of the chains through the elongated holes the springs are compressed together so that they can then be simply slid through the slit-like open elongated holes and then the springs arranged in the chain can spring back and mechanically lock in their normal condition. The springs are preferably barrel springs.

An advantageous embodiment is that the elongated holes end at a spacing from the end planes.

It is furthermore preferable that the elongated holes are formed centrally between the planes.

Furthermore it is advantageous when the edges of the elongated holes are closed by seams.

To further improve the mechanical toothing together of the chains of the first and second type, preferably the second group of chains each has in the region of the connecting seams of the containment an insert slit open in one or the other direction to the edge such that when the chains of the first and second group are engaged through each other the edge-open slits and the edge-closed elongated holes of each slit pair of the intermeshed chains are engaged with each other.

It is thereby advantageous when the length of the edge-open slits is equal to twice the length of the region of the containment which is left between the end of the corresponding edge of a closed elongated hole and the plane formed by the ends of the springs.

Furthermore preferably the edge-closed elongated holes have such a length that is at least smaller than the maximum diameter of the springs of the crossing second group of chains.

The inventive arrangement achieves that the chains are virtually meshed together and are fixed together relative to each other. This forms a finished box-spring core which constitutes an exceptional intermediate product because of its holding-together and that can be handled with little care until it is incorporated into a mattress in finished form. The connection means according to the invention ensures that the box-spring core holds together until it is finished.

BRIEF DESCRIPTION OF THE DRAWING

Embodiments of the invention are shown in the drawing and described more closely in the following.

There is shown in.

SPECIFIC DESCRIPTION

Figure 1:
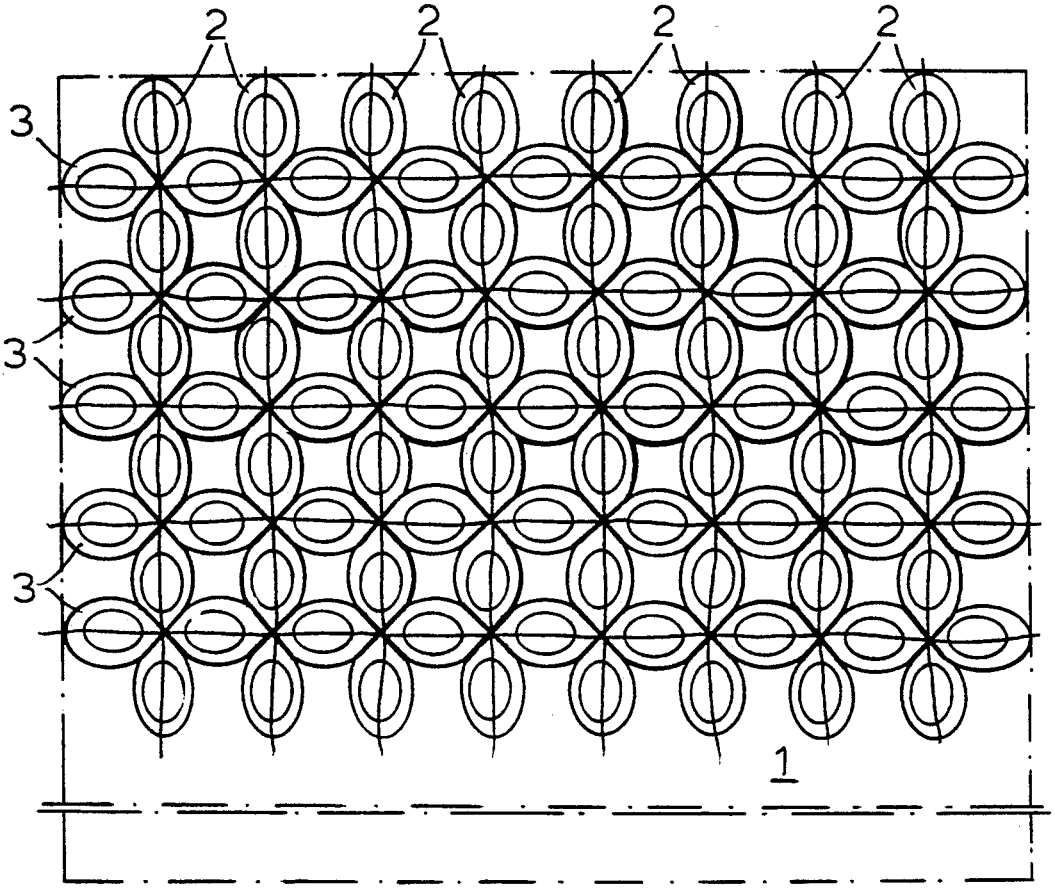
FIG. 1 a box-spring core according to the invention in view.
Figure 4:
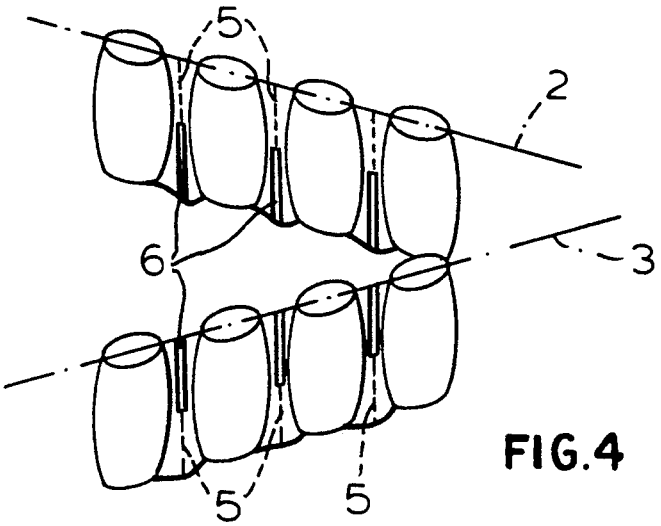
FIG. 4 a further detail in isometric representation.
Figure 2:
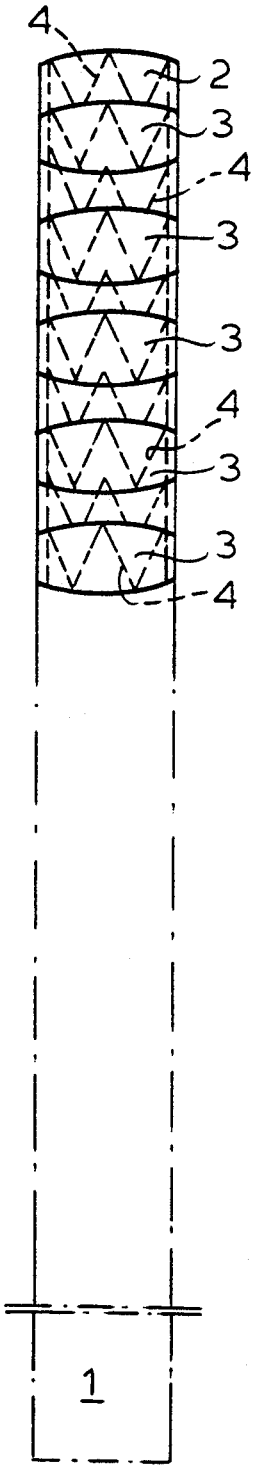
FIG. 2 the same in side view.
Figure 3:
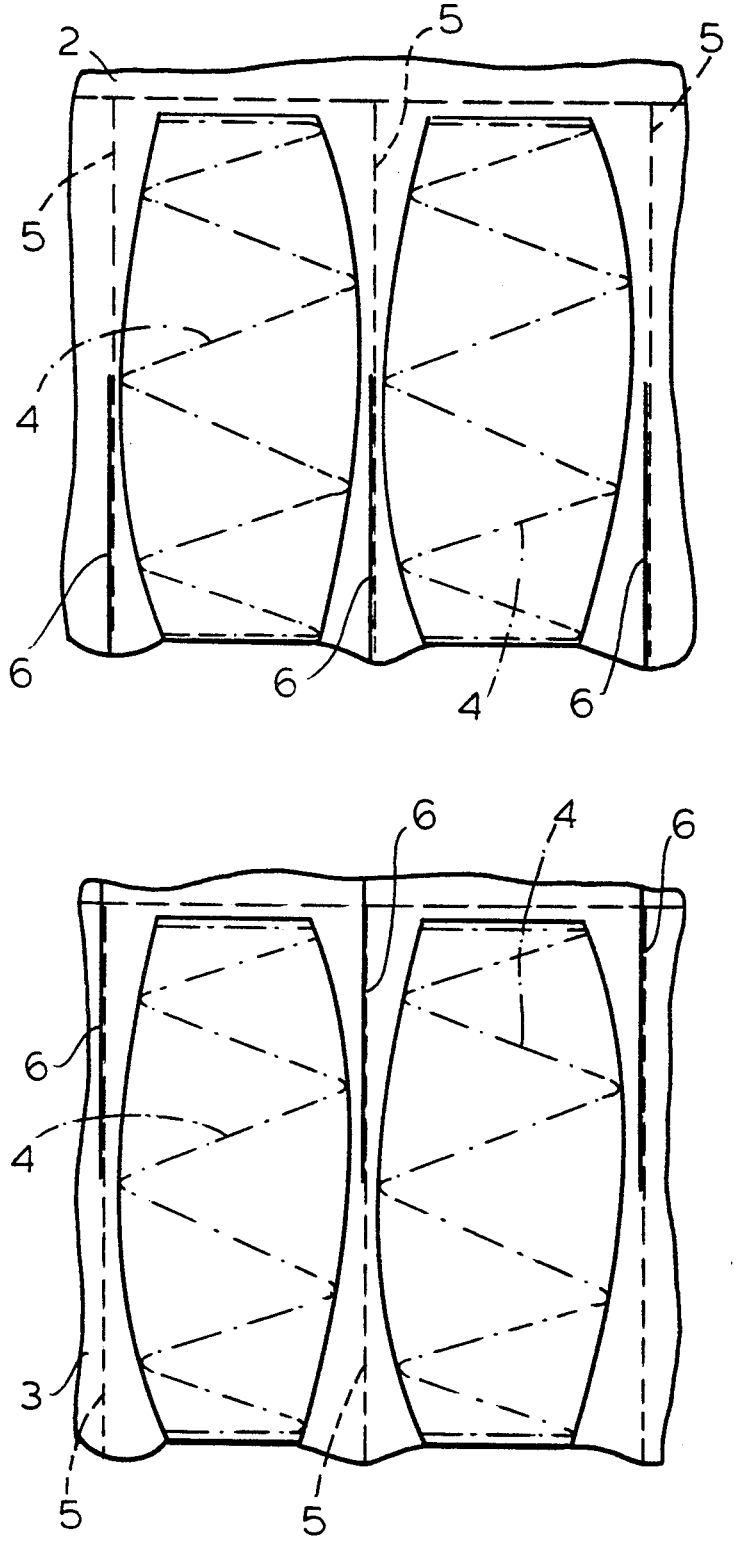
FIG. 3 a detail in enlarged scale.

The box-spring core 1 according to FIGS. 1 through 4 is comprised of a plurality of parallel chains 2, 3 of boxed springs, with each chain 2, 3 having a continuous row of springs 4 which are snugly encased by a clothlike sheath and which are connected together by it. The thus formed boxes of a chain 2, 3 are provided with transversely extending connecting seams 5 for containing the springs. These connecting seams 5 run parallel to the longitudinal axes of the springs 4. The adjacent chains 2, 3 are mechanically connected to one another. To this end the chains 2, 3 have in the region of the connecting seams insert slits 6 which extend over half the height of the chain and open to the same edge. A first group of the chains 2 is set spaced-apart parallel to each other with their slits 6 open in the same direction while a second group of chains 3 is set spaced-apart parallel to each other at a right angle to the first group of chains 2. Their slits 6 are also open in the same direction but oppositely to the slits 6 of the first group The first and second group of chains 2 and 3 is arranged with interengaging slits in rows and columns as this is shown in particular in FIG. 1. To this end the spaces formed between parallel rows 2, 3 are filled in gaps between the elements of the first group of chains by elements of the second group of chains 3. In this manner the elements of adjacent rows or columns are staggered relative to each other. In order to avoid that when the slits are formed the springs 4 are released in the slit region, that is no more fully surrounded by the box, each of the connecting seams 5 is formed as a double seam with the insert slits between these connecting-seam pairs. When necessary for dimensional reasons a web of the encasing material of the boxed springs 4 can be formed between each pair of connecting seams 5 of a chain 2 or 3.

The invention constitutes an extremely simple system for producing box-spring cores where any additional connecting means can be dispensed with.

Figure 5:
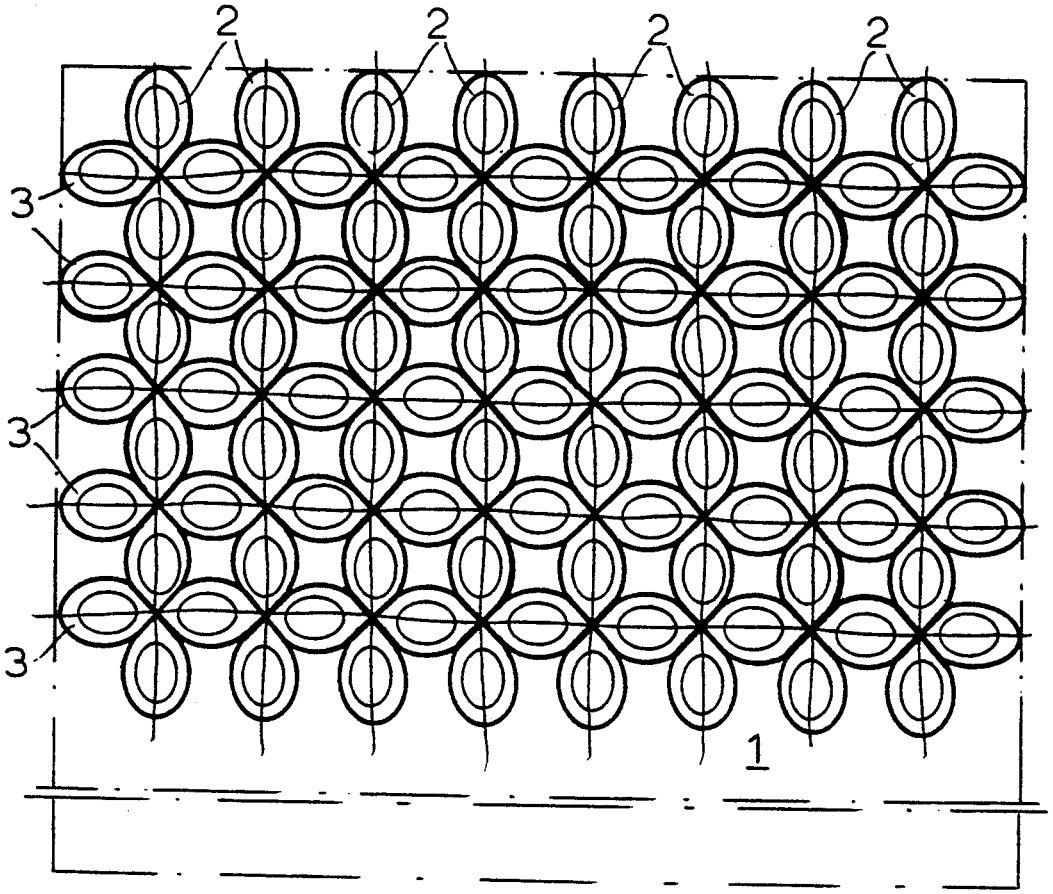
FIG. 5 a box-spring core in top view.
Figure 6:
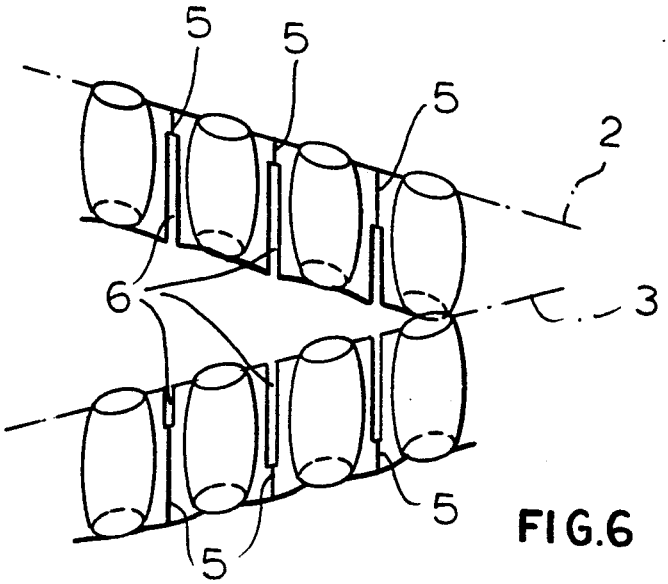
FIG. 6 a detail in enlarged view.
Figure 7:
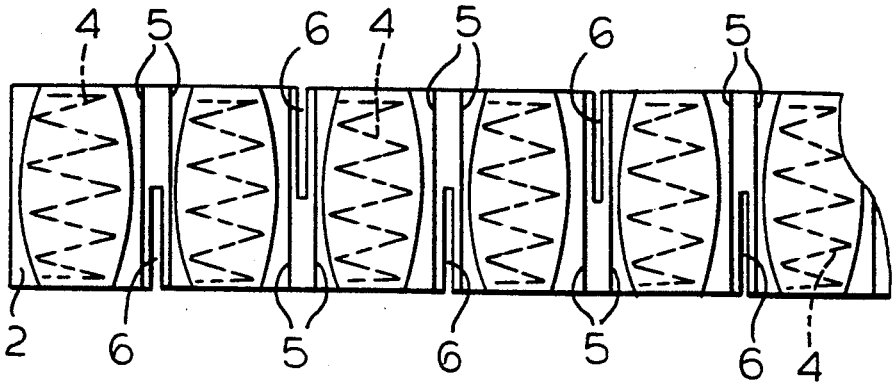
FIG. 7 a preferred variant in side view.

According to the embodiment of FIGS. 5 through 7 the box-spring core 1 is formed of a plurality of parallel chains 2, 3 of boxed springs, preferably barrel springs, with each chain 2, 3 having a continuous row of springs which are closely encased by a clothlike sheath and are connected together thereby. The thus formed boxes of a chain 2, 3 have in order to restrict the springs 4 perpendicular connecting seams 5. These connecting seams run parallel to the longitudinal axes of the springs. The adjacent chains 2, 3 are connected mechanically with each other. To this end the chains have according to FIG. 6 in the region of the connecting seams 6 respective insert slits 6 open to the same edge. A first group of chains is arranged spaced-apart parallel to each other with their slits directed in the same direction while a second group of chains 3 is arranged spaced apart parallel to each other at a right angle to the first group of chains 2. Their slits 6 are also directed in the same direction but opposite to the slits of the first group. The first and second group of chains 2 and 3 are arranged in rows and columns with interengaging slits 6 as this is shown in particular in FIG. 5. To this end the spaces formed between parallel rows 2, 3 are filled in gaps between the elements of the first group of chains 2 by elements of the second group of chains 3. In this manner the elements of adjacent rows or columns are staggered relative to each other. In order to avoid that the springs 4 are let out, that is no longer completely surrounded by the box, on forming the slits, each of the connecting seams 5 is formed as a double seam (See FIG. 7.) with the insert slits 6 formed between these connecting-seam pairs. When necessary for dimension reasons, a web of the encasing material of the boxed springs is formed between each pair of connecting seams 5 of a chain 2 or 3. This creates an extremely simple system for making box-spring cores, where one can dispense with all auxiliary means for connection.

As shown in particular in FIG. 6, the slits 6 that fit together as pairs can have different heights. In the slit pair of the chains 2 and 3 shown to the right in FIG. 6 the upper slit 6 reaches to the middle to the height of the respective chain while the opposing slit of the lower chain extends over well more than half of the chain height. Even in this embodiment fitting together is possible, producing an improved articulated coupling in the region of the slit 6 of the lower chain.

In the middle two slit pairs 6 which work together, both slits 6 are so long that they extend well past the middle of the height of the respective chain 2 or 3. Here also fitting together and bending are preferably possible while the ability of the material strip to hold together is somewhat worse.

In the embodiment on the left in FIG. 6 the lowermost slit 6 of chain 3 is so short that it stops well before the middle of the chain height while the slit 6 of the upper chain which fits together with the slit 6 of the lower chain extends well past the middle of the chain so that in any case after fitting together of the slits 6 it is sure that the end surfaces of all boxed springs form the two support planes of the box-spring core. Different slit formations are also possible.

In the embodiment according to FIG. 7 the arrangement of the slits 6 is set up such that the slits 6 alternately open to one or the other edge of the chain 2. The other chain 3 fitting with this chain is not shown here but is formed analogously. In this manner it is possible to fit the chains 2 and 3 together like a weave so that one slit 6 engages over the underneath chain and the next slit is engaged downwardly by this chain. Here also the slit length and arrangement is such that in every case two mutually planar support surfaces are formed by the box-spring core. Preferably the arrangement is such that the slits 6 extend over half the height of the chains. Alternate slit lengths and formation are possible and even desirable under some circumstances.

Figure 9:
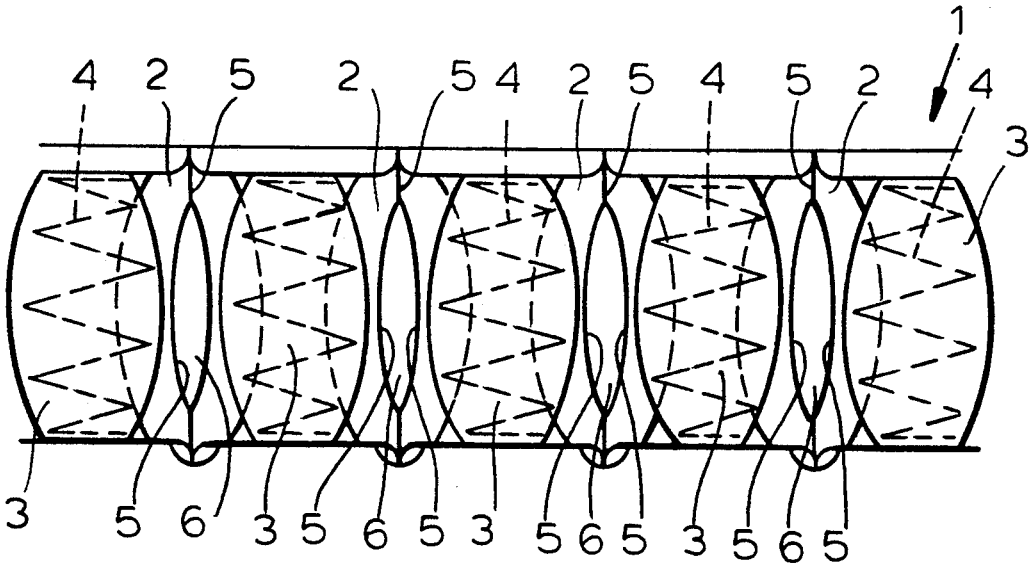
FIG. 9 same seen in section.
Figure 8:
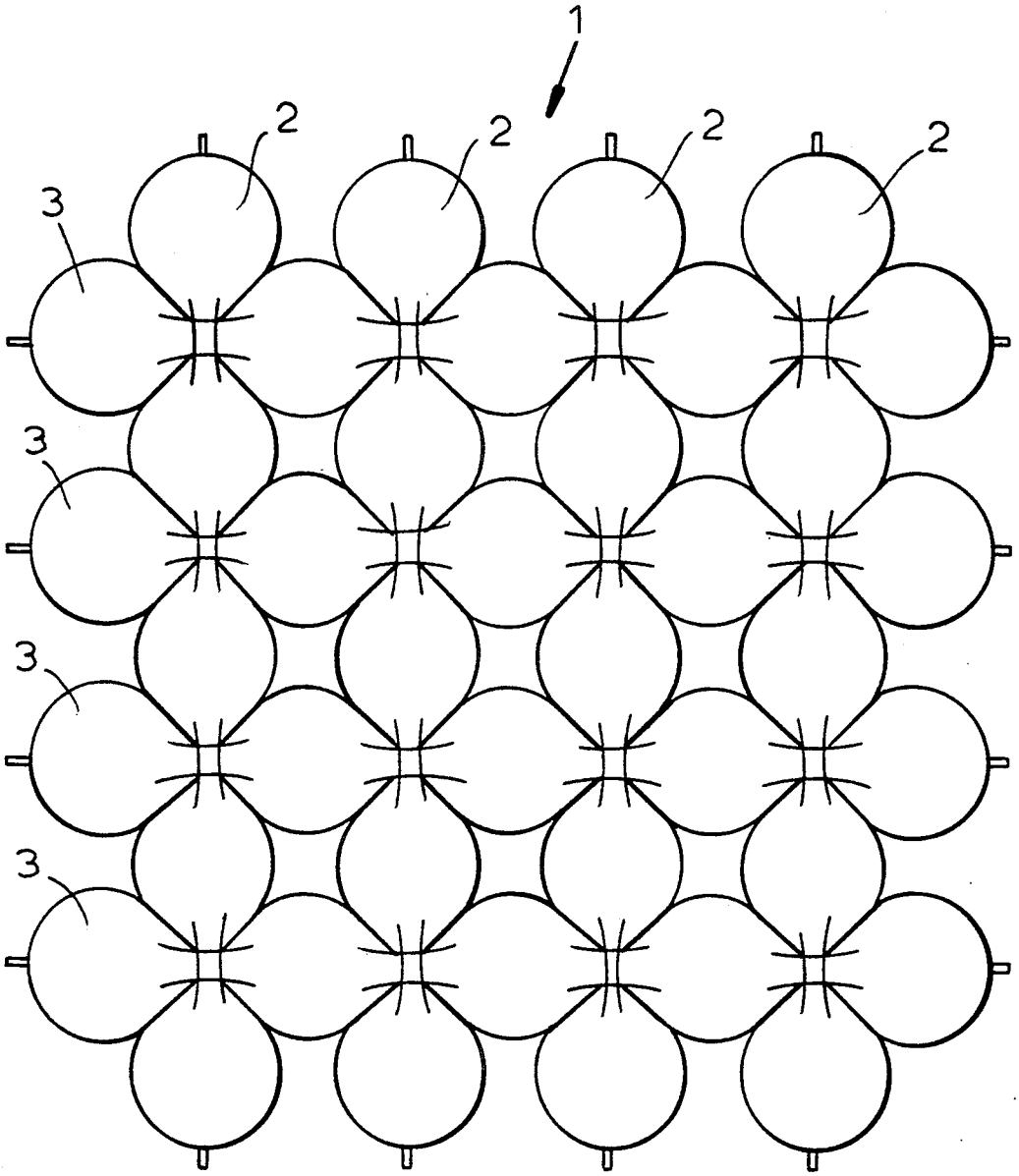
FIG. 8 a box-spring core according to the invention partly in section and top view.

According to the embodiment of FIGS. 8 and 9 the box-spring core 1 is formed of a plurality of parallel chains 2, 3 of boxed springs, preferably barrel springs, with each chain 2, 3 having a continuous row of springs 4 which are snugly encased by a cloth-like sheath and which are connected together by it. The thus formed boxes of a chain 2, 3 are provided with transversely extending connecting seams 5 for containing the springs. These connecting seams 5 run parallel to the longitudinal axes of the springs 4. The adjacent chains 2, 3 are mechanically connected to one another. To this end a first group of chains 3 has in the region of the connecting seams identically directed slits whose several chains are arranged parallel to one another. A second group of the chains 2 is arranged with spaced chains 2, 3 that have in the region of the connecting seams insert slits 6 which extend over half the height of the chain and open to the same edge. A first group of the chains 2 is set spaced-apart parallel to each other with their slits 6 open in the same direction while a second group of chains 3 is set spaced-apart parallel to each other at a right angle to the first group of chains 2, the first and second group of chains 3, 2 being arranged in rows and columns and the spaces formed between parallel rows 2, 3 are filled in gaps between the elements of the first group of chains 2 by elements of the second group of chains 3 so that the elements of adjacent rows or columns are staggered relative to each other. Furthermore each chain of the second group of chains is arranged such that it extends through the aligned elongated holes 6 of the group of chains formed by the first group of chains, a seam 5 of the chain 2 being arranged in the region of a respective elongated hole.

As particularly shown in FIG. 9 the elongated holes end before the edge planes. In addition the elongated holes are arranged centrally between the planes. In addition the edges of the elongated holes 6 are closed by seams (connecting seams 5). It is also possible that the second group of chains 2 has in the region of the connecting seams 5 of the casing insert slits open to one or the other edge so that when one chain (3, 2) is inserted through the other the outwardly open slits and the outwardly closed holes 6 of the respective slit pairs of the intertoothed chains 3, 2 fit with one another. In addition the outwardly closed elongated slots have such a length that is at least slightly more than the maximum diameter of the springs of the crossing second group of chains 2. When the springs 4 are compressed together it is therefore possible to slip them through the elongated slots easily and without ripping the material and when the chain of the second group 2 is properly positioned according to FIG. 1, to release the springs so that they spring up and assume the position of FIG. 8.

We claim:

1. A box-spring core comprising:

a first group of first chains extending spacedly adjacent and parallel to one another and each having an elongated flexible sheath formed with a plurality of longitudinally spaced, transversely extending, and throughgoing slits that are each transversely aligned with the slits of adjacent sheaths, a transverse seam adjacent each slit, the seams internally subdividing the respective sheaths into a respective succession of longitudinally spaced pockets, and respective springs in the respective pockets each compressible in a transverse direction parallel to the slits, the springs having opposite ends lying generally in respective parallel planes; and a second group of second chains extending adjacent and parallel to one another and transversely of the first chains and each having an elongated flexible sheath formed with a plurality of longitudinally spaced, transversely extending, and throughgoing slits fitted with respective slits of the first group such that the second-chain sheath lies generally between the planes, each sheath having a predetermined height measured perpendicularly between the planes, each slit having a predetermined length measured perpendicularly between the planes, the combined lengths of a pair of interfitting slits being generally equal to the predetermined height, a transverse seam adjacent each second-chain slit, the second-chain seams internally subdividing the second-chain sheath into a succession of pockets, and respective springs in the respective second-chain pockets and each compressible in a transverse direction parallel to the respective slits, the second-chain springs having opposite ends lying generally in the respective parallel planes.

2. The box-spring core defined in claim 1 wherein each sheath has longitudinally extending opposite edges generally on the planes, the slits opening at the planes.

3. The box-spring core defined in claim 2 wherein the first-chain slits all open at the edges on one of the planes and the second-chain slits all open at the edges on the other of the planes.

4. The box-spring core defined in claim 2 wherein alternating slits of each sheath open transversely oppositely, whereby the sheaths must be woven together to form the core.

5. The box-spring core defined in claim 1 wherein each slit length is equal generally to half the predetermined height.

6. The box-spring core defined in claim 1 wherein each seam is a transverse row of stitches.

7. The box-spring core defined in claim 6 wherein each seam is a pair of rows of stitches longitudinally flanking the respective slit.

8. The box-spring core defined in claim 1 wherein the springs are coil springs.

9. The box-spring core defined in claim 8 wherein the coil springs are barrel springs.

10. The box-spring core defined in claim 1 wherein the sheaths are of cloth.

11. A box-spring core comprising:

a first group of first chains extending spacedly adjacent and parallel to one another and each having an elongated flexible sheath formed with a plurality of longitudinally spaced, transversely extending, and throughgoing slits that are each transversely aligned with the slits of adjacent sheaths, a transverse seam adjacent each slit, the seams internally subdividing the respective sheaths into a respective succession of longitudinally spaced pockets, and respective springs in the respective pockets each compressible in a transverse direction parallel to the slits, the springs having opposite ends lying generally in respective parallel planes; and a second group of second chains extending adjacent and parallel to one another and transversely of the first chains and each having an elongated flexible sheath formed with a plurality of longitudinally spaced, transversely extending, and throughgoing slits fitted with respective slits of the first group such that the second-chain sheath lies generally between the planes, the first-chain slits being formed as transversely elongated holes and the second-chain slits being oppositely outwardly open short slits, the second chains extending through the elongated holes of the first chains, a transverse seam adjacent each second-chain slit, the second-chain seams internally subdividing the second-chain sheath into a succession of pockets, and respective springs in the respective second-chain pockets and each compressible in a transverse direction parallel to the respective slits, the second-chain springs having opposite ends lying generally in the respective parallel planes.

12. The box-spring core defined in claim 11 wherein each elongated hole is of a size sufficient that the second-chain springs can fit through them when compressed.

* * * * *